United States Patent [19]

Bier et al.

[11] 4,114,416

[45] Sep. 19, 1978

[54] ROLLING DISC ATTACHMENT

[75] Inventors: Albert Bier; Herbert Vogelgesang, both of St. Ingbert, Saar, Fed. Rep. of Germany

[73] Assignee: Moeller & Neumann GmbH, St. Ingbert, Saar, Fed. Rep. of Germany

[21] Appl. No.: 829,219

[22] Filed: Aug. 31, 1977

[30] Foreign Application Priority Data

Sep. 2, 1976 [DE] Fed. Rep. of Germany ..... 2639543

[51] Int. Cl.[2] ..... B21B 31/08

[52] U.S. Cl. ..... 72/238; 29/125

[58] Field of Search ..... 72/237–239; 29/117, 125, 129.5, 130

[56] References Cited

U.S. PATENT DOCUMENTS

| | | | |
|---|---|---|---|
| 3,803,691 | 4/1974 | Geese et al. | 29/263 |
| 3,866,283 | 2/1975 | Gould | 72/238 |
| 3,945,235 | 3/1976 | Oxlade | 72/238 |

*Primary Examiner*—Milton S. Mehr

*Attorney, Agent, or Firm*—John J. Dennemeyer

[57] ABSTRACT

Apparatus for clamping an overhung rolling disc on a drive shaft by compressive stress between plane parallel surfaces, whereby a hydraulically expansible tie-rod is inserted in the hollow drive shaft for producing the compressive stress, the tightening nut of which tie-rod is located opposite the outer end face of the rolling disc for transmitting the compressive force, wherein the tightening nut is seated on a bayonet ring provided with an external screw-thread, the bayonet ring with the tightening nut is supported by a bayonet nut, which is in turn screwed on a threaded end of the tie-rod and a taper sleeve is inserted between the rolling disc and drive shaft, the free outer end face of which taper sleeve is located opposite an end face of the bayonet ring and is constructed for the attachment of extraction claws.

1 Claim, 1 Drawing Figure

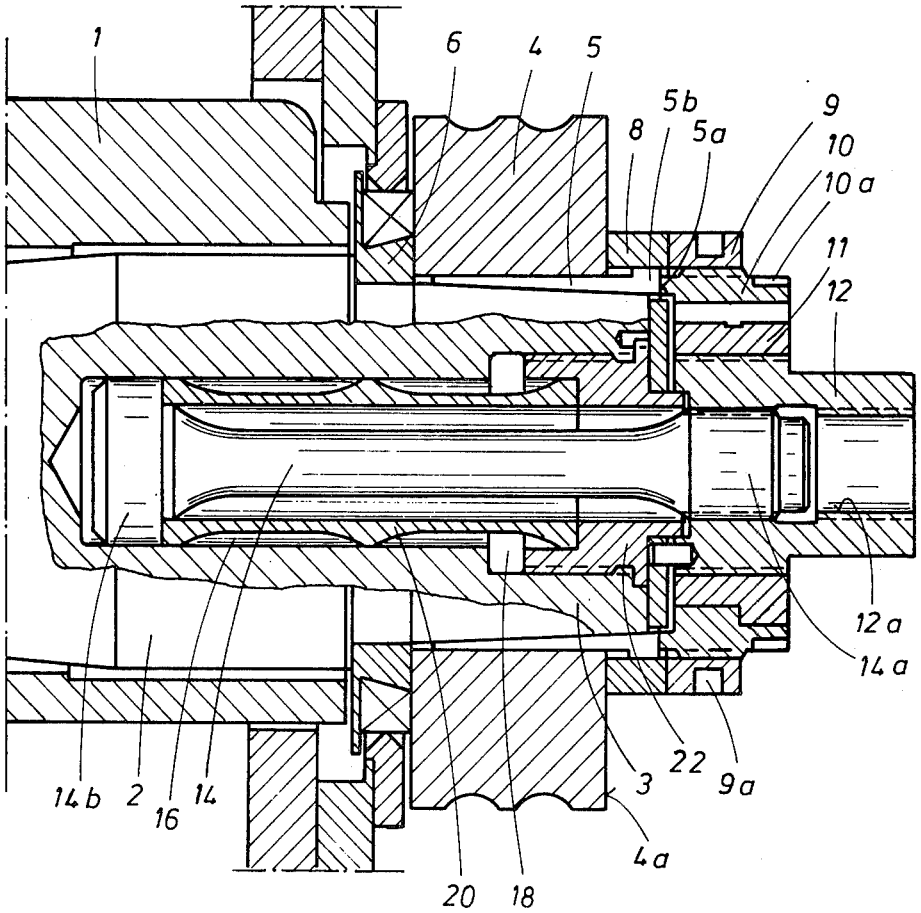
1
6
4
5
5b
8
5a
9
10
10a
11
12
12a
14a
22
9a
3
4a
20
18
14b
2
16
14

ROLLING DISC ATTACHMENT

The invention relates to an apparatus for clamping an overhung rolling disc on a drive shaft by compressive stress between plane parallel surfaces, a hydraulically expansible tie-rod being inserted in the hollow drive shaft for producing the compressive stress, the tightening nut of which tie-rod is located opposite the outer end face of the rolling disc for transmitting the compressive force. Particularly for rolling discs of hard metal, it is recommended to bring the latter into non-rotary connection with the drive shaft exclusively by compressive stress between plane parallel surfaces, since rolling discs of this type made of hard metal do not tolerate concentrations of stress owing to a notch effect or excessive circumferential stress (German Pat. No. 1,286,490). Excessive circumferential stress could occur if a rolling disc is clamped radially on the drive shaft by means of one or more conical annular parts or taper sleeves (U.S. Pat. No. 1,528,392).

As regards the production of compressive stress for clamping a rolling disc, the known possibility consists of expanding the drive shaft elastically by hydraulic clamping pressure, in order to transfer this compressive force to the rolling disc by slackening the drive shaft and a tightening nut or inserting a spacer ring. Within the framework of the invention, use is made of the possibility of inserting a hydraulically expansible tie-rod in the hollow drive shaft, as recommended in U.S. Pat. No. 3,945,235.

Overhung rolling discs are used mainly in wire mills, where very high rotary speeds occur. It is therefore intended to mount a rolling disc, which is in non-rotary connection with the drive shaft, exclusively by compressive stress between plane parallel surfaces, in an absolutely true manner, without the feared circumferential stresses being able to occur in the rolling disc. This object is fulfilled according to the invention due to the fact that the tightening nut of the tie-rod is seated on a bayonet ring provided with an external screw-thread, the bayonet ring with the tightening nut is supported by a bayonet nut, which is in turn screwed on a threaded end of the tie-rod and that a taper sleeve is inserted between the rolling disc and drive shaft, the free outer end face of which taper sleeve is located opposite one end face of the bayonet ring and is constructed for the attachment of extraction claws.

In known manner, the taper sleeve inserted in the bore of the rolling disc ensures that the rolling disc is mounted on the drive shaft free from play and in an absolutely true manner. However, care is taken that the axial force for driving in the taper sleeve can be adjusted by hand and when the tie-rod has not been expanded, in that one end face of the rotary bayonet ring is located opposite the outer end face of the taper sleeve, with respect to which bayonet ring, the outer tightening nut is itself able to rotate for transmitting the high compressive force for clamping the rolling disc.

One embodiment of a rolling disc attachment according to the invention is shown in the drawings in axial section and partly in elevation. The drawing shows one end of the drive shaft 2 located in a housing 1, on the conical seat part 3 of which shaft 2, the rolling disc 4 is clamped. A taper sleeve 5 serves for the clamping of the rolling disc 4 free from play and in a true manner. The rolling disc 4 is clamped exclusively by compressive stress between plane parallel surfaces, in that the inner end face of the rolling disc 4 bears against a thrust ring 6 rotating with the drive shaft 2, whereas the outer end face **4*a* is located opposite a thrust ring 8, which can be placed under axial pressure by a tightening nut 9. The tightening nut 9 is seated on a bayonet ring 10 provided with an external screw-thread, the inner end face of which ring is located opposite the free outer end face 5*a* of the taper sleeve 5. The bayonet ring 10 is supported by a bayonet nut 11, which is in turn screwed onto a threaded end 12 as part of a tie-rod 14. For assembly and production reasons, the threaded end 12 is connected to the head 14*a* of the tie-rod 14** by a screw-thread.

The drive shaft 2 comprises a blind bore 16 for receiving the tie-rod 14 as well as a larger bore 18 preceding this blind bore 16. A sleeve 20 which is elastic under compression is inserted in the blind bore 16, which sleeve is supported at one end against the inner head **14*b* of the tie-rod 14 and at the other end against a flange bush 22 screwed into the bore 18. The extension length of the tie-rod 14 is increased by the sleeve 20 which is elastic under compression, since the compressive deformation of the sleeve 20 must be added to the extension of the tie-rod 14 under an axial force acting on the threaded end 12** (German Pat. Nos. 1,159,886 and 1,183,464).

To explain the assembly of the rolling disc attachment according to the invention, it should be mentioned that the tie-rod 14, 20 can be extended by attaching a known hydraulic nut (German Pat. No. 875,426), in which case the hydraulic nut (not shown) is connected in a tension-resistant manner by means of the internal screw-thread **12*a* of the threaded end 12 adjacent the tie-rod. The hydraulic nut is thus supported by means of a cup-shaped support part on the outer end face 4*a* of the rolling disc 4**.

To assemble the rolling disc 4, the outer and inner surface of the taper sleeve 5 are firstly treated with a durable lubricant and then the taper sleeve is introduced into the inner bore of the rolling disc 4. In this case, the taper sleeve should be approximately 5° to 10° K. cooler than the rolling disc, so that after an equalization of temperature, there is a type of shrink fit between both parts. The rolling disc 4 with the taper sleeve 5 is then pushed onto the conical seat 3 of the drive shaft 2 until it abuts against the thrust ring 6. The thrust ring 8 is then mounted. The bayonet ring 10 with the tightening nut 9 screwed onto its outer screw-thread is then placed on the bayonet nut 11, which is screwed onto the threaded end 12 of the tie-rod 14 and remains there permanently. The bayonet ring 10 is tightened against the outer end face **5*a* of the taper sleeve 5 with a predetermined torque by means of a domed torque wrench (not shown) which engages recesses 10*a* in the bayonet ring 10. In this case, the tie-rod 14 is in the non-extended position. The axial force for pushing the taper sleeve 5 between the rolling disc 4 and the conical seat 3 of the drive shaft 2 can thus be adjusted irrespective of the application of the axial force for clamping the rolling disc 4 such that no harmful circumferential stresses occur in the rolling disc 4 of hard metal, but it is ensured that the rolling disc 4 is seated without clearance and in a true manner. After tightening the bayonet ring 10, the tightening nut 9 should be tightened to such an extent that the rolling disc 4 has no clearance between the two thrust rings 8 and 6**.

The hydraulic nut (not shown) is then put in position which — as stated — is supported at one end against the end face 4*a* of the rolling disc 4 and at the other end is connected to the head 14*a* of the tie-rod in a tension-resistant manner by screwing a set-screw into the inner screw-thread 12*a* of the part 12. By means of the hydraulic clamping pressure inside the hydraulic nut, the tie-rod 14 is subjected to tensional elongation and the sleeve 20 is subjected to compressive elongation, since the abutment of the sleeve 20 which is elastic under compression, on the bush 22 is stationary. Under the tensile elongation of the tie-rod 14 and the compressive elongation of the sleeve 20, the threaded end 12 of the tie-rod moves together with the bayonet nut 11, the bayonet ring 10 and the tightening nut 9 towards the right. A clearance is thus produced between the thrust ring 8 and the tightening nut 9, which clearance is eliminated by tightening the tightening nut 9. For tightening the tightening nut 9, the latter comprises peripherally distributed radial holes 9*a* for inserting a rotary handle, which can be introduced through recesses in the cup-shaped support part of the hydraulic nut (not shown).

Now, when the hydraulic pressure inside the hydraulic nut is released, the tie-rod tends to shorten and the sleeve 10 to lengthen, so that the threaded end 12 of the tie-rod tends to return to the original position, towards the left. Since this is only partly possible, the pre-tension of the tie-rod is transmitted as compressive force by the tightening nut 9 to the thrust ring 8 and part of the outer end face 4*a* of the rolling disc 4, which is thus clamped exclusively by compressive stress between plane parallel surfaces. All the screw-threads are locked so that neither the tightening nut 9, nor the bayonet ring 10, nor the bayonet nut 11 or threaded end 12 can be loosened. After removing the hydraulic nut, the rolling disc attachment according to the invention is ready for operation.

One proceeds in the reverse order for dismantling the rolling disc 4, in that the tie-rod 14 is firstly placed under tensile stress by means of the hydraulic nut, due to which the tightening nut 9 becomes free, in order to be screwed back. After this, the hydraulic nut and the bayonet ring 10 with the tightening nut 9 and thrust ring 8 can be removed. An extraction tool is necessary for removing the rolling disc 4 with the taper sleeve 5 fitted by shrinkage, the extraction claws of which tool are able to engage the taper sleeve 5. For this purpose, in the region of its outer end face 5*a*, the taper sleeve 5 is provided with a thickened collar 5*b*. The rolling disc 4 and taper sleeve 5 always remain connected.

The bayonet ring 10 can be constructed as a nut with a steep internal thread, whose corresponding external thread is located on the bayonet nut 11.

What is claimed is:

1. Apparatus for clamping an overhung rolling disc on a hollow drive shaft by compressive stress between plane parallel surfaces thereof, comprising a hydraulically expansible tie-rod insertable in the hollow drive shaft for producing the compressive stress, a tightening nut located opposite an outer end face of the rolling disc for transmitting the compressive stress, said tightening nut being seated on a bayonet ring provided with an external screw-thread, the bayonet ring with the tightening nut being supported by a bayonet nut, said bayonet nut being in turn screwed on a threaded end of the tie-rod and a taper sleeve being inserted between the rolling disc and drive shaft, the free outer end face of said taper sleeve being located opposite an end face of the bayonet ring and being constructed for the attachment of extraction claws.

* * * * *